United States Patent [19]

Zinger

[11] Patent Number: 4,786,052

[45] Date of Patent: Nov. 22, 1988

[54] BASKETBALL RETURN

[76] Inventor: Kurt E. Zinger, 449 Zehnder Dr., Frankenmuth, Mich. 48734

[21] Appl. No.: 894,036

[22] Filed: Aug. 7, 1986

[51] Int. Cl.[4] ..... A63B 63/08

[52] U.S. Cl. ..... 273/1.5 A

[58] Field of Search ..... 273/1.5 R, 1.5 A, 395–397; 239/505, 509, 510, 511, 513, 514, 515, 521–524; 52/97; D21/201; 93/2 R

[56] References Cited

U.S. PATENT DOCUMENTS

| | | | |
|---|---|---|---|
| 544,928 | 8/1895 | Patterson | 239/505 X |
| 2,060,938 | 11/1936 | Johnson | 273/396 X |
| 2,838,308 | 6/1958 | Polite | 273/396 X |
| 2,889,149 | 6/1959 | Williams | 273/396 |
| 3,544,109 | 12/1970 | Woods | 273/396 X |
| 3,913,916 | 10/1975 | Martin, Jr. | 273/396 |

FOREIGN PATENT DOCUMENTS

| | | | |
|---|---|---|---|
| 129588 | 8/1932 | Austria | 239/509 |

*Primary Examiner*—Paul E. Shapiro

*Attorney, Agent, or Firm*—John J. Swartz

[57] ABSTRACT

A basketball return for deflecting a basketball, which has passed through a basketball hoop, in a direction away from a hoop mounting backboard including a mounting portion which is sandwiched between a basketball hoop mounting bracket and the backboard and a downwardly inclined, forwardly extending portion having a terminal end which is disposed forwardly of the vertical hoop axis and rearwardly of the forward end of the hoop.

2 Claims, 1 Drawing Sheet

BASKETBALL RETURN

BACKGROUND OF THE INVENTION

1. FIELD OF THE INVENTION

This invention relates to a basketball return for deflecting a basketball, which has passed through an annular basketball hoop, in a direction away from a backboard on which the basketball hoop is mounted.

2. DESCRIPTION OF THE PRIOR ART AND OBJECTS

A typical homeowner's basketball goal assembly includes an annular rim mounted on a backboard which in turn is mounted on a ground embedded, vertical pole adjacent one lateral side of a concrete drive way. When a basketball passes through such a goal, the basketball frequently will not remain "in play" on the concrete driveway, but rather will drop onto the adjacent grass and possibly bounce into a neighboring yard, an adjacent street, or other undesirable locations. Accordingly, it is an object of the present invention to provide a new and novel basketball return for deflecting a basketball, which has passed through a basketball hoop, in a direction away from the basketball backboard.

Various basketball return devices have been provided heretofore such as that disclosed in U.S. Pat. No. 3,233,896, issued to J. L. King on Feb. 8, 1966 and U.S. Pat. No. 3,776,550, issued to James R. McNabb on Dec. 4, 1983. Each of these prior art devices utilizes a chute which extends in a path from a location generally at the basketball rim to the feet of the player. Such prior art devices are cumbersome, complicated, expensive and not, easily disassembled.

U.S. Pat. No. 3,799,543, issued to Joseph R. Steele, Jr. on Mar. 26, 1974 discloses a basketball deflector which is detachably mounted on the rim via a series of magnets which are relatively expensive and have limited ability to maintain the deflector in position.

U.S. Pat. No. 3,814,421, issued to William Spier, Jr. on June 4, 1974 likewisely discloses a chute which is somewhat shorter than the McNabb and King devices, but nonetheless, is relatively expensive, complicated, and substantially different from applicant's construction.

Accordingly, it is another object of the present invention to provide a basketball return deflector which is simple, easy to construct, easy to mount and dismount and relatively inexpensive.

Basketball goal assemblies typically include a vertically disposed backboard mounting a generally horizontally disposed basketball hoop via a 90° bracket assembly having a flat vertical plate provided with four bolt holes therethrough which receive bolts that couple the bracket to the backboard. A deflector constructed according to the present invention includes a flat mounting plate which is disposed between the mounting bracket and the backboard. It may occur that relatively young players will have to mount this device on a used assembly and it would be cumbersome if, prior to installing the basketball return, the young user would have to completely remove the basketball hoop from the backboard. Accordingly, still another object of the present invention is to provide a new and novel basketball return which can be mounted between the hoop mounting bracket and the backboard without the necessity of completely removing the basketball hoop from the backboard.

It is yet another object of the present invention to provide a basketball return deflector which can be securely mounted by sandwiching a portion of the deflector between the bracket for mounting the basketball hoop and the backboard.

Still another object of the present invention is to provide a basketball return deflector utilizing a minimum amount of material.

Other objects and advantages of the present invention will become apparent to those of ordinary skill in the art as the description thereof proceeds.

SUMMARY OF THE INVENTION

A basketball return for a basketball goal assembly including a backboard, a forwardly extending annular hoop having a basketball receiving opening through which a basketball can pass in a vertical path, and a bracket for mounting the hoop on the backboard, the return comprising: a downwardly extending, forwardly inclined basketball deflector disposed below and in vertical alignment with the hoop opening; mount mechanism, integral with the deflector portion, for mounting the deflector in such position as to be engaged by the basketball vertically passing through the hoop to forwardly deflect the basketball from a vertical path, the mount mechanism including an upper portion receivable between the bracket and the backboard.

BRIEF DESCRIPTION OF THE DRAWINGS

The present invention may be more readily described by reference to the accompanying drawings, in which.

DESCRIPTION OF THE PREFERRED EMBODIMENT

Figure 1:
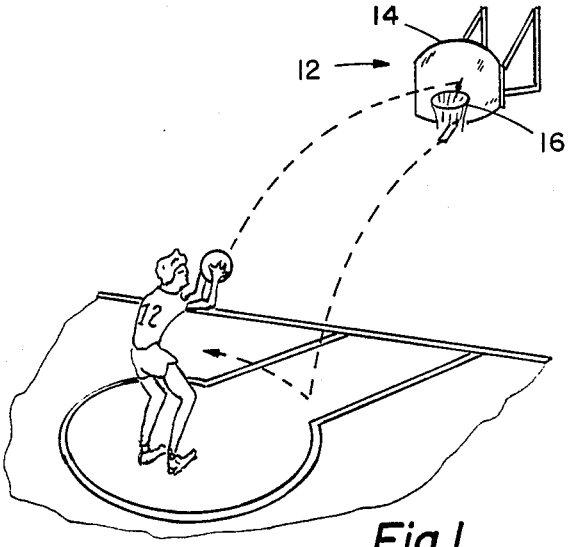
FIG. 1 is a perspective view, generally illustrating a fragmentary perspective view of a basketball court including a typical basketball goal assembly having a basketball return deflector, constructed according to the present invention, mounted thereon.
Figure 2:
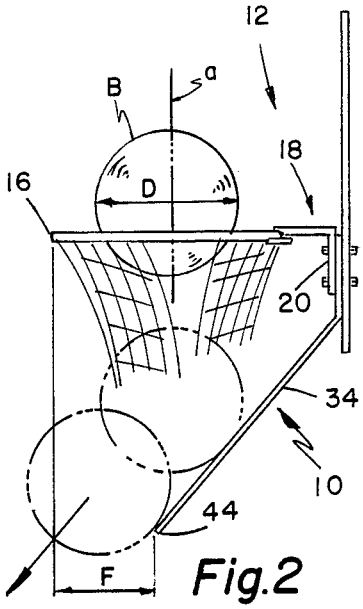
FIG. 2 is a greatly enlarged side elevational view illustrating a device constructed according to the present invention mounted on a basketball goal assembly and also illustrating the path of a basketball passing through a basketball hoop.
Figure 3:
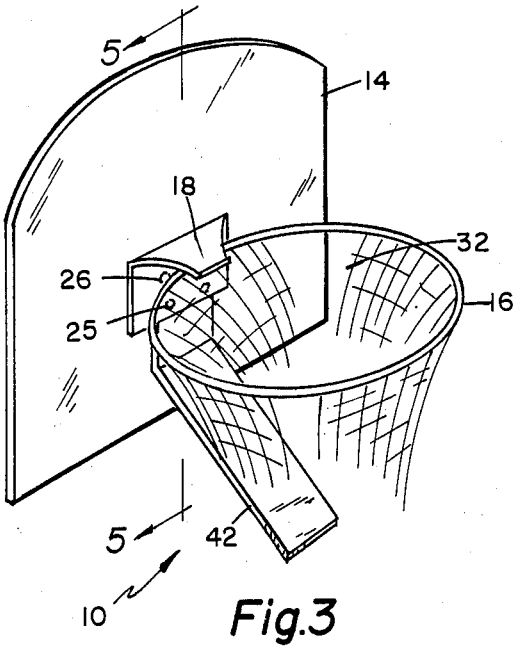
FIG. 3 is a further enlarged perspective view of the apparatus illustrated in FIGS. 1 and 2.
Figure 4:
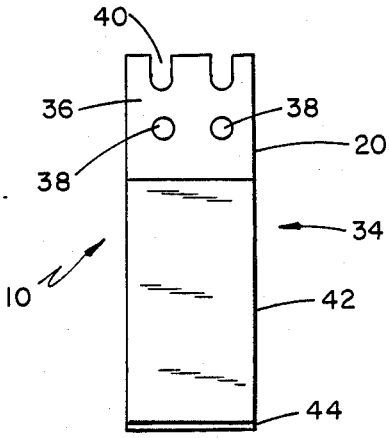
FIG. 4 is a front elevational view illustrating the apparatus constructed according to the present invention.
Figure 5:
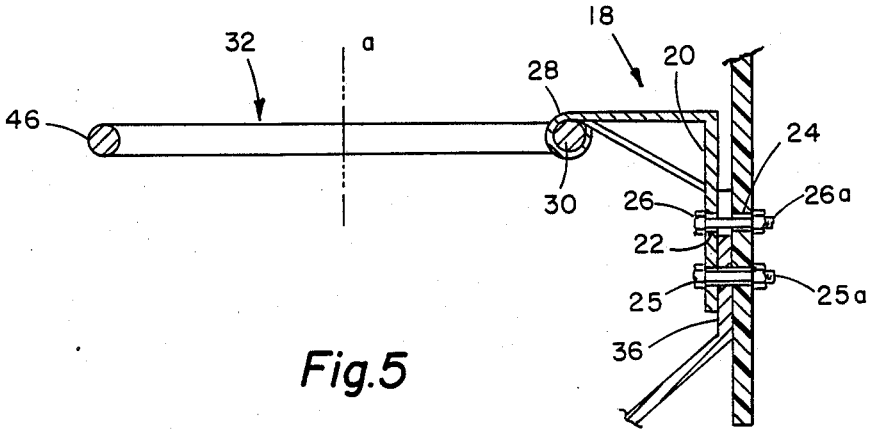
FIG. 5 is a sectional side view taken along the line 5—5 of FIG. 3.

A basketball return deflector, generally designated 10, constructed according to the present invention, is particularly adapted for use with a basketball goal assembly, generally designated 12, having a generally vertical, planar, backboard 14 mounting an annular horizontally disposed rim or basketball hoop 16 via a right-angled mounting bracket, generally designated 18. The bracket 18 for mounting the hoop or rim 16 on the backboard includes a flat, vertical back plate 20 having a plurality of openings 22 therethrough aligned with complimental openings 24 in the backboard 18 through which horizontally disposed lower and upper pairs of mounting bolts 25 and 26 pass. The mounting bracket 18 includes a horizontal portion 28 integral with back plate 20 and welded or otherwise suitably fixed to the rearwardmost portion 30 of the rim or hoop 16. The rim or hoop 16 includes an opening or passage 32 through which a basketball, generally designated B, vertically passes. The bolts 25 and 26 are detachably secured in the positions illustrated in FIG. 5 via threaded nuts 25*a* and 26*a* respectively.

The basketball return device 10 includes an integral plate 34 having a generally planar mounting portion 36 provided with a pair of lower mounting opertures 38 therethrough and a pair of upper, upwardly opening, open ended slots 40, for a purpose to become immediately apparent.

The deflector 34 includes a lower downwardly inclined forwardly extending deflector portion 42 having a terminal end 44 which is forward of the vertical axis a of the hoop 16. To insure that the basketball B is deflected, the deflector 34 is of such construction and so positioned that the horizontal distance F between a vertical plane P, which is parallel to the plane of the backboard 14 and intersects the inner edge of the forwardmost hoop portion 46 of the hoop 16, and the terminal end portion 44 is less than the diameter D of the basketball.

The device is mounted on an existing goal assembly 10 by completely removing the two lowermost bolts 25 from the backboard 14. The nuts 26*a* on the uppermost bolts 26 are not removed but merely "loosened" in an amount sufficient to allow the bracket 18 to be moved away from the backboard 14*a* sufficient to allow the upper return mounting portion 36 to be moved upwardly between the backboard 14 and the mounting plate 20 to the position illustrated in FIG. 5.

In this position, the upper upwardly opening slots 40 will receive the uppermost bolts 26 and the lowermost bolts 25 are then reinserted into the lowermost aligned openings 22 and 24 in the mounting bracket 20 and the backboard and the nuts 26*a* and 25*a* are again tightened to securely sandwich the portion 36 between the bracket 20 and the backboard 14.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. A basketball return for a basketball goal assembly including a backboard, a forwardly extending annular hoop having a basketball receiving opening through which a basketball can pass in a vertical path; and bracket means for mounting said hoop on said backboard, said return comprising:

a downwardly extending, forwardly inclined basketball deflector adapted to be disposed below and in vertical alignment with said hoop opening; and mount means, integral with said deflector, mounting said deflector in such position as to be engaged by a basketball vertically passing through the hoop so as to forwardly deflect the basketball from a vertical path;

said mount means comprising an upper rearwardly disposed flat plate, having a plurality of bolt receiving openings extending therethrough, receivable between said bracket means and said backboard;

said plurality of openings include at least one upwardly opening, open ended slot.

2. In combination:

a generally planar, vertical backboard;

a forwardly extending, generally horizontal, annular hoop having a basketball receiving opening, having a vertical axis, through which a basketball can pass in a vertical path;

bracket means for mounting said hoop on said backboard;

a ball deflector including an upper, rearward mounting portion, sandwiched between said mounting bracket and said backboard, and a downwardly extending, forwardly inclined portion, integral with said mounting portion, disposed below and in vertical alignment with said hoop opening so as to be engaged by a basketball so as to forwardly deflect said basketball from a vertical path of travel;

said downwardly extending forwardly inclined portion including a terminal and disposed forwardly of the vertical axis of said hoop and rearwardly of the forwardmost portion of said hoop.

* * * * *